US007750582B2

(12) United States Patent
Moriyasu et al.

(10) Patent No.: US 7,750,582 B2
(45) Date of Patent: Jul. 6, 2010

(54) LIQUID CRYSTAL DISPLAY DEVICE

(75) Inventors: Mitsuhiro Moriyasu, Suzuka (JP); Hideyuki Chikazawa, Tsu (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 847 days.

(21) Appl. No.: 11/604,846

(22) Filed: Nov. 28, 2006

(65) Prior Publication Data

US 2007/0120505 A1 May 31, 2007

(30) Foreign Application Priority Data

Nov. 29, 2005 (JP) ..... 2005-343757

(51) Int. Cl.
*H05B 37/02* (2006.01)

(52) U.S. Cl. ..... 315/291; 315/149; 315/308; 315/309

(58) Field of Classification Search ..... 315/291, 315/308, 30, 149, 309
See application file for complete search history.

(56) References Cited

U.S. PATENT DOCUMENTS 6,198,234 B1 3/2001 Henry
6,495,964 B1 * 12/2002 Muthu et al. ..... 315/149
2002/0053886 A1 5/2002 Hara et al.
2003/0230991 A1 12/2003 Muthu et al.
2004/0264212 A1 12/2004 Chung et al.
2005/0088102 A1 4/2005 Ferguson et al.

FOREIGN PATENT DOCUMENTS

EP 1667102 A2 6/2006
JP 2004-139876 A 5/2004
WO WO 01/47037 A1 6/2001

* cited by examiner

*Primary Examiner*—David Hung Vu
(74) *Attorney, Agent, or Firm*—Birch, Stewart, Kolasch & Birch, LLP

(57) ABSTRACT

When the temperature value detected by a temperature detecting circuit is lower than a previously designated set temperature value, cathode fluorescent lamps (CFLs) are operated to illuminate with a duty ratio of 100% so as to enhance the brightness. When the detected temperature value has become equal to or higher than the previously designated set temperature value, CFLs are operated to illuminate by changing the duty ratio into a user set value.

6 Claims, 8 Drawing Sheets

$I_F=(V-V_F \times 6)/R$

1
ANT
10
Receiving circuit
12
Selector circuit
14
Decoder circuit
16
Video processing circuit
18
20
LCD panel
22
Color sensor
30
Backlight
32
CFL
34
LED
40
Temperature detecting circuit (thermistor)
42
Inv circuit
44
LED drive circuit
S1
S2
50
Controller
60
Storage
62
Video adjustment setup information
70
Input unit

FIG.4

| Items | Set values |
|---|---|
| Brightness | +16 |
| Video | +32 |
| Black level | 0 |
| Color density | +2 |
| Hue | 0 |
| Image quality | 0 |

LIQUID CRYSTAL DISPLAY DEVICE

This Nonprovisional application claims priority under 35 U.S.C.§119(a) on Patent Application No. 2005-343757 filed in Japan on 29 Nov. 2005, the entire contents of which are hereby incorporated by reference.

BACKGROUND OF THE INVENTION

1. Field of the Invention

The present invention relates to a liquid crystal display device.

2. Description of the Prior Art

Conventionally, one of the display devices for displaying images, videos and others, liquid crystal display devices (LCD) that make use of liquid crystal have been known. LCDs have been mostly utilized as display devices for computers, cellular phones, television sets and the like. In a liquid crystal display device, a special liquid is sandwiched and sealed between two glass plates, and when an electric field is applied across the liquid, a change in the orientation of liquid crystal molecules occurs so that the light transmittance of the liquid varies to thereby display an image. In this process, since the liquid crystal itself does not emit light, cathode fluorescent lamps (CFLs) and the like are equipped on the rear side of the liquid crystal as a light source, and this light source is used as a backlight.

Here, a CFL is a light source involving three RGB wavelengths. However, if the power (brightness) of CFL is increased, all the colors are uniformly raised in brightness, so it has been impossible to make correction to one particular color alone.

To deal with this problem, recently, configurations using two kinds of light sources as a backlight have been emerging. For example, there is a configuration in which light emitting diodes (LEDs) are used in combination with CFLs as a backlight (which will be called "hybrid backlight" hereinbelow as appropriate) (see Patent document 1: Japanese Patent Application Laid-open 2004-139876, for example). Specifically, in order to enhance red color of CFLs, red LEDs of a longer wavelength are used to improve color reproducibility with CFLs at the same time.

However, the above hybrid backlight configuration entails the following problem. That is, it has been known that the luminous intensity of CFLs at startup is lower than the designated value. Accordingly, if the user has selected a low brightness for backlighting, the CFLs cannot but present an extremely low luminous intensity. In order to keep the white balance constant, it is necessary to inhibit the luminous intensity of the red LEDs. To achieve this, however, it is necessary to make the current ($I_F$) supplied to the LEDs very low in order to suppress influence on the luminous intensity. In this case, if current $I_F$ is set to a markedly low value, there occurs the problem that the LEDs will not light correctly because of an insufficiency of the current supplied to the LEDs.

Particularly, when a CFL having temperature-dependent characteristics having a peak brightness at ambient temperatures of about 30 to 40 deg. C., is started up or is being used at a low ambient temperature, it may present as low a brightness as the half of the brightness when the backlight becomes stabilized after a temperature rise by virtue of the parts being heated. Accordingly, the LEDs that are designated and expected to successfully deal with such CFL characteristics need to have a broader light intensity adjustable range than that of the CFL. However, it is only possible to extract sufficient LED illumination characteristics when a forward voltage of about 1.6 to 1.8 V is applied to each LED element, so that there is a certain limit that the light intensity of LEDs can be adjusted, hence resulting in inability of correct illumination. For example, there have occurred the problems that LEDs cannot be totally turned on and that LEDs are turned on but flickering.

Referring now to FIG. 1, a specific description will be given. In FIG. 1, six LEDs are connected in series. To turn on LEDs, the voltage $V_F$ to be applied across a single LED is usually 1.6 to 1.8 [V] while the current $I_F$ flowing the LED is about 5 to 10 [mA]. Also, a resistance R for adjusting the current through the LEDs is connected in series. Here, the following description is made assuming that a resistance R of 430 [Ω] is used.

In FIG. 1, when a voltage of 14 [V] is applied across the whole circuit, the voltage $V_F$ applied across the series of six LEDs becomes equal to 1.6×6=9.6 [V]. Accordingly, the current $I_F$ is calculated as (14−9.6)/430≈10 [mA]. In this case, the LEDs will be turned on correctly.

However, if the voltage V is varied to 11 [V] in order to reduce the LED brightness, the current $I_F$ is sharply reduced to (11−9.6)/430≈3 [mA], which cannot turn on the LEDs correctly.

In this way, when a backlight with a series of LEDs is used, there occurs the inherent problem that it is impossible to perform lighting control by voltage control only.

SUMMARY OF THE INVENTION

In view of the above problem, the present invention is aimed at providing a liquid crystal display device capable of achieving improved color reproducibility even if plural kinds of light sources are used as the backlight.

In order to achieve the above object, a liquid crystal display device according to the first aspect of the present invention, includes: a liquid crystal display element; a backlight disposed on the rear side of the liquid crystal display element, having a first light source and a second light source different in spectral characteristics from the first light source; a first lighting control means for performing lighting control of the first light source by applying a voltage to the first light source with a predetermined duty ratio; a second lighting control means for performing lighting control of the second light source by applying a voltage to the second light source with a predetermined duty ratio; and a temperature detecting means for detecting the temperature inside the liquid crystal display device, and is characterized in that the first lighting control means performs lighting control by applying a voltage to the first light source with a duty ratio of 100% until the temperature detected by the temperature detecting means becomes equal to or greater than a first predetermined temperature.

The second aspect of the present invention is the liquid crystal display device having the above first feature, further including: a duty ratio setup means for setting the duty ratio for the first light source, and is characterized in that when the temperature detected by the temperature detecting means has become equal to or greater than the first predetermined temperature, the lighting control of the first light source is performed by applying a voltage to the first light source with the duty ratio set by the duty ratio setup means.

The third aspect of the present invention is characterized in that in that, in the liquid crystal display device having the above first or second feature, when the temperature detected by the temperature detecting means became equal to or greater than the first predetermined temperature, and then has become lower than a second predetermined temperature that is lower than the first temperature, the first lighting control means performs lighting control by applying a voltage to the first light source with a duty ratio of 100%.

The fourth aspect of the present invention is characterized in that, in any of the liquid crystal display devices having the first through third aspects, the first light source is composed of cathode fluorescent lamps, and the second light source is composed of light emitting diodes.

The fifth aspect of the present invention is any of the liquid crystal display devices having the first through fourth aspects, further comprising: a color sensor for detecting RGB values of light emitted from the backlight, and is characterized in that the second lighting control means determines the duty ratio for the second light source in accordance with the RGB values detected by the color sensor, and thereby performs lighting control.

In accordance with the first aspect of the present invention, lighting control can be performed by applying a voltage to the first light source with a duty ratio of 100% until the temperature inside the liquid crystal display device becomes equal to or greater than a predetermined temperature. For example, when cathode fluorescent lamps are used as the first light source, it is possible to enhance the brightness by setting the duty ratio to be 100% even though the brightness of cathode fluorescent lamps is low when it is started up (during low temperatures). As a result it is possible to perform the whole display of the liquid crystal display device in a well-balanced condition.

In accordance with the second aspect of the present invention, when the detected temperature has become equal to or higher than the previously set first temperature, lighting control will be performed in the set duty ratio. Accordingly, when the detected temperature becomes equal to or higher than the first temperature, the brightness is adjusted into that designated by the user, so that the power consumption, for example can be reduced.

In accordance with the third aspect of the present invention, when the detected temperature became equal to or greater than the first predetermined temperature, then has become lower than the second predetermined temperature that is lower than the first temperature, lighting control is performed with the duty ratio set at 100%. Accordingly, even if the temperature becomes lower than the first temperature, it is possible to control the temperature so as to keep suitable brightness, by performing lighting control with a duty ratio of 100%.

In accordance with the fourth aspect of the present invention, the first light source is composed of cathode fluorescent lamps (CFLs), and the second light source is composed of light emitting diodes (LEDs). Accordingly, even in a liquid crystal display device using a hybrid backlight made up of cathode fluorescent lamps which present a large temperature-dependent variation and light emitting diodes which are prone to be affected by change in voltage, it is possible to secure suitable brightness.

In accordance with the fifth aspect of the present invention, lighting control is performed by detecting the RGB values of light emitted from the backlight and determining the duty ratio for the second light source in accordance with the detected RGB values. Accordingly, it is possible to set up suitable white balance in the backlight.

BRIEF DESCRIPTION OF THE DRAWINGS

FIG. 4 is a chart showing one example of video adjustment setup information;

DESCRIPTION OF THE PREFERRED EMBODIMENTS

Now, the embodiment in which a liquid crystal display device of the present invention is applied to an LCD television will be described with reference to the drawings.

[Configuration]

Figure 1:
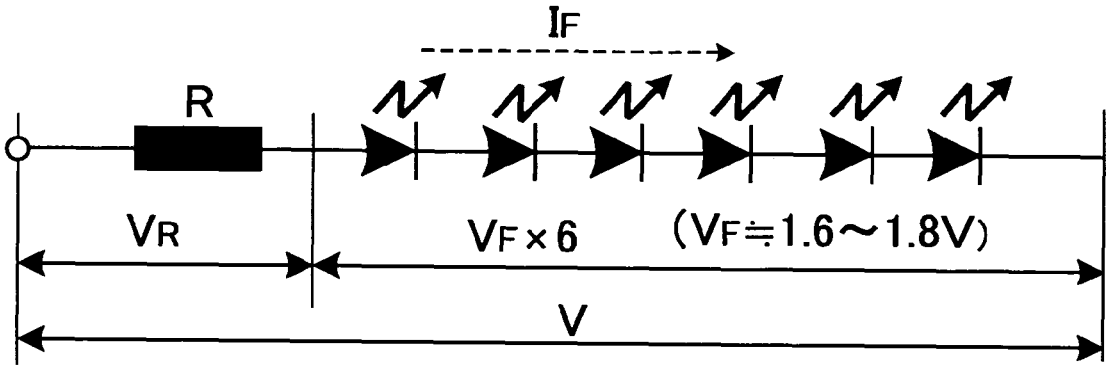
FIG. 1 PRIOR ART
FIG. 1 is a diagram showing a connected status of LEDs.
Figure 2:
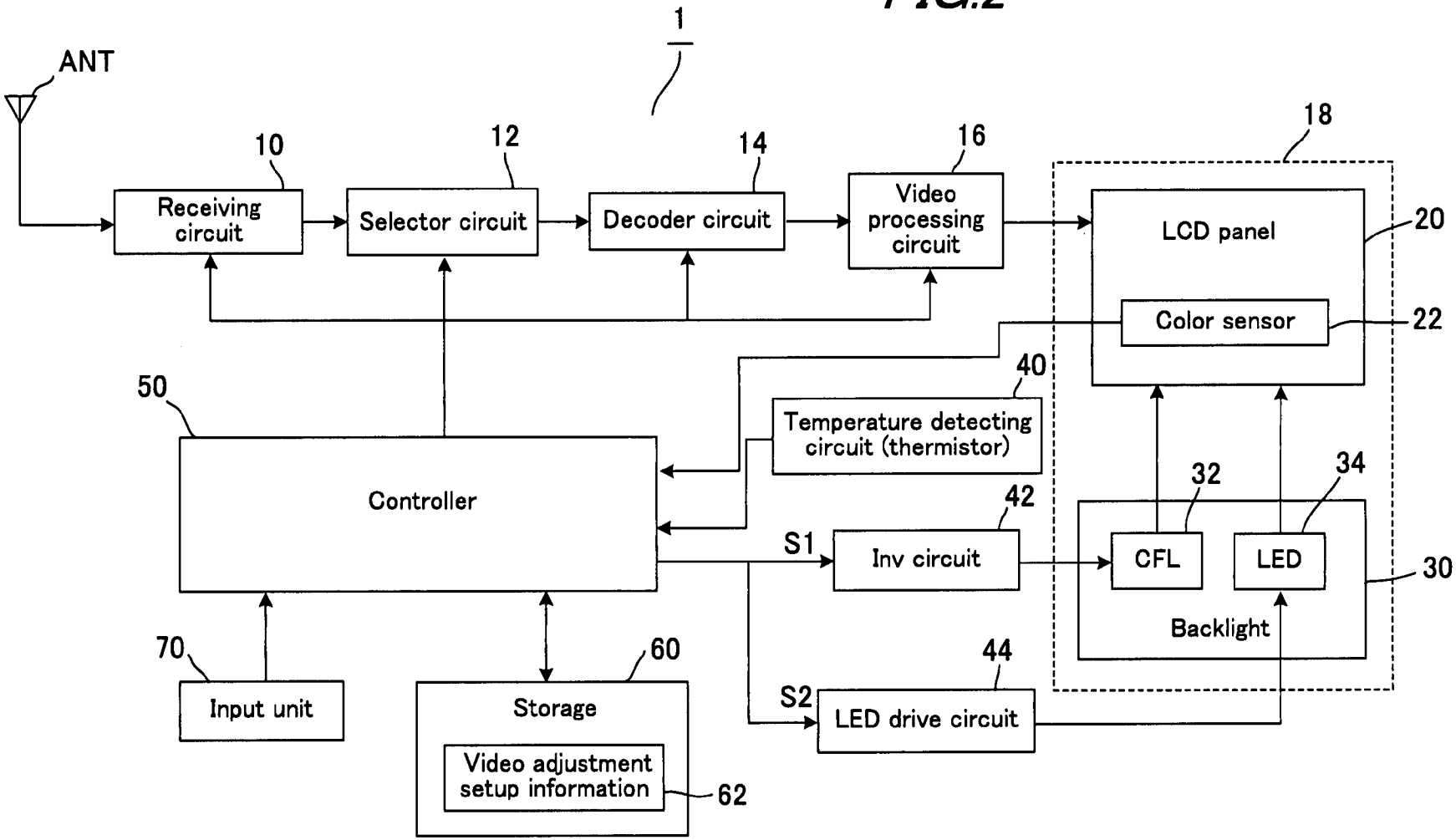
FIG. 2 is a block diagram showing an LCD television to which the present invention is applied.

FIG. 2 is a block diagram showing a configuration of an LCD television 1. LCD television 1 includes a receiving circuit 10, a selector circuit 12, a decoder circuit 14, a video processing circuit 16, an LCD 18, a temperature detecting circuit (thermistor) 40, an inverter (INV) circuit 42, an LED drive circuit 44, a controller 50, a storage 60 and an input unit 70, and has an external antenna ANT connected thereto.

LCD 18 is composed of an LCD panel 20 and a backlight 30, which are housed integrally. LCD 18 further includes a color sensor 22 that detects RGB values based on the light irradiated by the backlight for LCD panel 20. In addition, backlight 30 includes as its light sources a CFL module 32 and a LED module 34.

Receiving circuit 10 extracts broadcast signals from the received signals input via external antenna ANT and outputs them to selector circuit 12. Selector circuit 12 selects a broadcast signal corresponding to the channel selected by the user, and outputs it to decoder circuit 14. Decoder circuit 14 decodes the input broadcast signal to generate a video signal, which in turn is output to video processing circuit 16.

Video processing circuit 16 subjects the input video signal to various video processes and outputs the processed signal to LCD 18. Here, as the video processes, various kinds of processes can be considered; for example, the user designates "brightness", "hue" and the like, and the processor implements video processes over the signal based on the user set values. Finally, LCD 18 displays a video in accordance with the input video signal so that the user is able to watch the received broadcast.

LCD 18 is composed of LCD panel 20 and backlight 30. For example, backlight 30 is disposed on the rear side of LCD panel 20, and two components are integrally configured. Light emitted from backlight 30 passes through LCD panel 20 and reaches the user so that user can watch a video and the like.

LCD panel 20 is formed of, for example, two glass plates in which liquid crystal is sealed, and the exterior is enclosed by a box or the like made of metal plates and others. Formed on the surface of the bottom glass plate of LCD panel 20 are a plurality of source electrodes and a plurality of gate electrodes in a matrix-wise pattern, so that one TFT is formed for each pixel. LCD panel 20 further includes color sensor 22 for detecting the RGB values of light that is radiated from backlight 30 and passes through the liquid crystals in LCD panel 20. Here, the light source for backlight 30 uses both CFL module 32 of cathode fluorescent lamps and LED module 34 of light emitting diodes.

CFL module 32 is composed of, for example, cathode fluorescent lamps or the like and outputs light of RGB wavelengths. In accordance with an INV-output control signal S1 supplied from controller 50, INV circuit 42 turns on and performs lighting control of CFL module 32 based on PWM (pulse width modulation)-lighting control. Here, PWM-lighting control is a lighting control method of controlling the luminous intensity by applying a pulsating rectangular wave voltage of a predetermined frequency to INV circuit 42 as the circuit for driving CFL module 32, and controlling the duty ratio of the pulsating voltage. When the duty ratio is 100%, the brightness of LCD 18 (backlight 30) is maximized.

LED module 34 is composed of light emitting diodes etc., for example. Here, red light emitting diodes are used, for example. The red light emitting diodes output red-colored light having longer wavelengths than the wavelengths of red colored light emitted from CFL module 32. In accordance with an LED output control signal S2 supplied from controller 50, LED drive circuit 44 turns on, and performs lighting control of LED module 34 based on a current light control scheme. Here, the current light control scheme is a lighting control method of adjusting the brightness of LEDs by varying the magnitude of the current supplied to LED modules 34, in accordance with the input LED output control signal.

Figure 3:
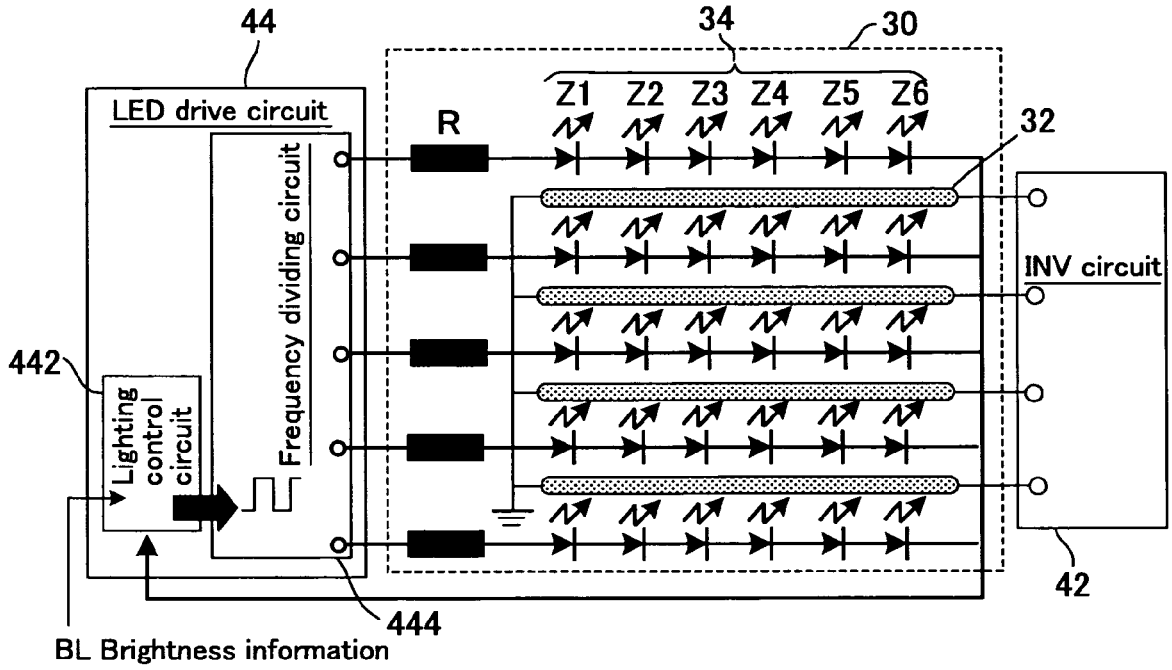
FIG. 3 is a diagram showing a LCD configuration.

FIG. 3 is a diagram showing backlight 30, INV circuit 42 and LED drive circuit 44. In backlight 30, a plurality of CFLs 32 are equi-distantly arranged in parallel to each other and electrically connected in parallel with each other and coupled to INV circuit 42. On the other hand, in LED module 34, a plurality of LEDs (six LEDs in the drawing) are connected in series (the state where LEDs are connected in series (e.g., diodes Z1 to Z6 in FIG. 3) is called an LED series), and each LED series is connected to a frequency dividing circuit 444 of LED drive circuit 44 by way of a resistance R. Here, frequency dividing circuit 444 is a circuit that equally outputs currents to all LED series connected in parallel. Here, the magnitude of the output current is determined by a lighting control circuit 442. Lighting control circuit 442 determines the magnitude of the current based on the backlight brightness information input from controller 50 and the signal fed back from each LED series, and outputs.

Temperature detecting circuit 40 (FIG. 2) is a sensor circuit for measuring the temperature inside LCD television 1. For example, the circuit includes a thermistor and others, and detects the temperature inside LCD television 1, on demand and output it as detected temperature value T to controller 50. Though various locations may be considered for temperature detection, the present embodiment will be described assuming that the temperature of the backlight is detected. Other than this, the temperature of the control panel, the temperature inside the housing of LCD television 1 are of course also suitable.

Controller 50 implements processes based on the predetermined programs in accordance with input instructions, and transfers instructions and data to various functional units. Specifically, controller 50 controls various circuits and functional units in LCD television 1. Here, controller 50 is constructed of a CPU (central processing unit) or the like, for example.

Storage 60 is an on-demand writable memory which temporarily holds various processes to be executed by controller 50 as well as data etc. for executing these programs. Storage 60 also stores video adjustment setup information 62. This storage 60 is composed of RAM (random access memory), memory card, HDD and/or the like, for example.

FIG. 4 is a chart showing one example of video adjustment setup information 62 stored in storage 60. Video adjustment setup information 62 has set values (e.g., "+16") with respect to setup items (e.g., "brightness") stored. Here, a set value is a value that is designated by the user.

Figure 8:
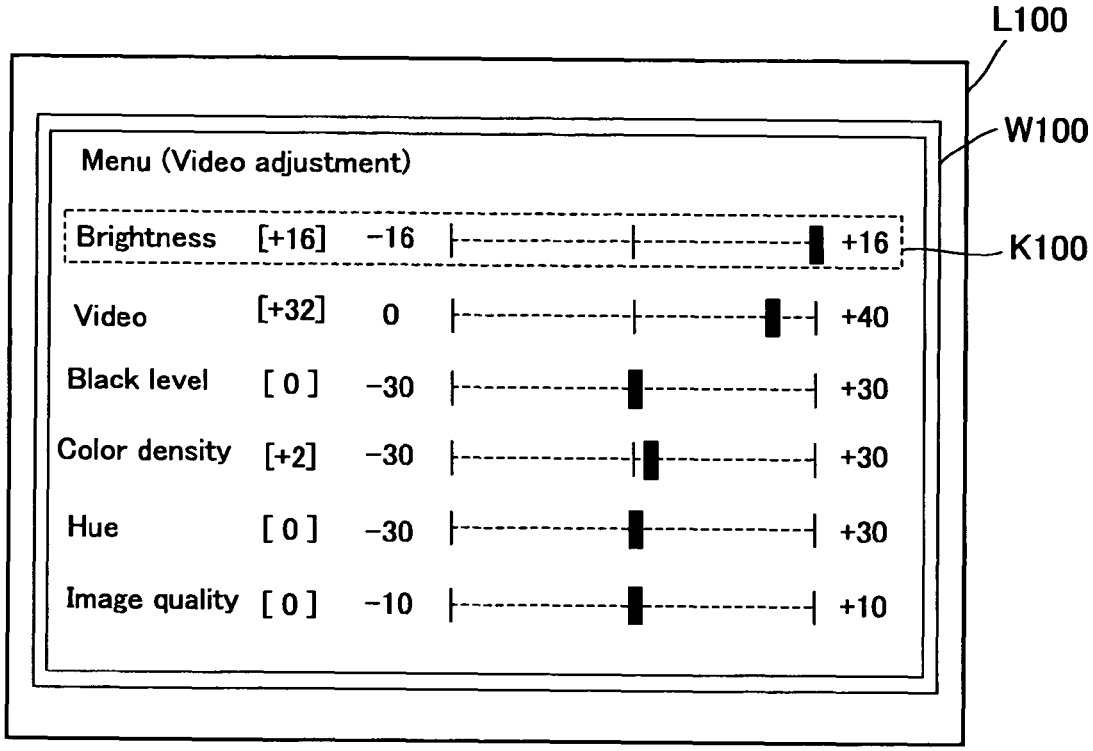
FIG. 8 is a diagram showing an example of a display frame of video adjustment setup information.

FIG. 8 is a diagram showing a display frame example for setting up video adjustment setup information. In a display frame L100 on LCD 18, a window W100 for setting up video adjustment setup information is displayed. As the user inputs and/or modifies and enters the set values, the data is stored into storage 60 as video adjustment setup information 62. Referring to an area K100 in FIG. 8 as an example, "+16" is stored as the brightness value. The brightness has levels ranging from "−16" to "+16". Setting at "−16" corresponds to a setup of a duty ratio of "0%" and setting at "+16" corresponds to a setup of a duty ratio of "100%".

Input unit 70 (FIG. 2) is an input device having keys required for input of control instructions from the user and outputs a key signal to controller 50 when a key is pressed. Key input in this input unit 70 allows the user to change the video adjustment setup information for example.

[Operation]

Figure 5:
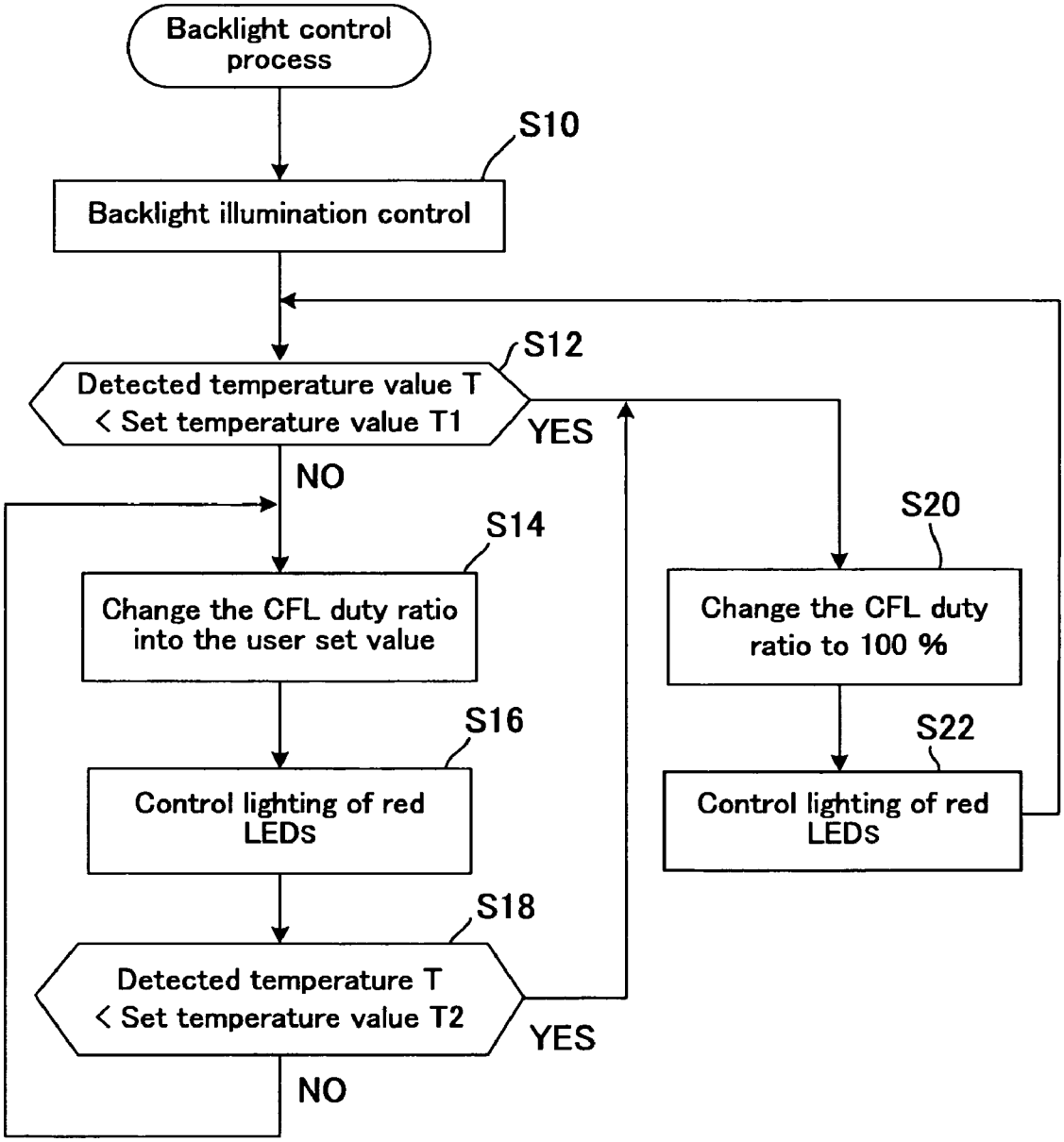
FIG. 5 is a flowchart showing an operation sequence of a backlight control process.

Next, the operation of LCD television 1 in the present embodiment will be described. FIG. 5 is a flowchart showing an operation sequence for illustrating a backlight control process in the present embodiment. This backlight control process is a process effected on hardware by controller 50 (FIG. 2) controlling individual circuit portions.

To begin with, as the power is turned on, a backlight illumination control process is started (Step S10). Illustratively, INV-output control signal S1 from controller 50 is output to INV circuit 42. Then, INV circuit 42 controls CFL module 32 to make it illuminate. Also, LED output control signal S2 is output from controller 50 to LED drive circuit 44. In response to this, LED drive circuit 44 controls LED module 34 to make it illuminate.

Here, controller 50 makes a comparison between the detected temperature value T input from temperature detecting circuit 40 and a set temperature value T1 which is set beforehand (Step S12). In this case, when detected temperature value T is lower than set temperature value T1 (Step S12: Yes), the CFL duty ratio is set at 100% (Step S20). INV circuit 42 turns on CFLs 32 with a duty ratio of 100% (maximum brightness).

Subsequently, controller 50 controls lighting of red LED module 34 (Step S22). Here, to perform lighting control of LED module 34, the RGB values in LCD panel 20 are detected by color sensor 22, for example. Based on the detected RGB values, the duty ratio for lighting control of LED module 34 (red LEDs) is determined.

Then, controller 50 outputs LED output control signal S2 based on the determined lighting control duty ratio to LED module 34. LED module 34 drives the LEDs based on the input LED output control signal.

Figure 6:
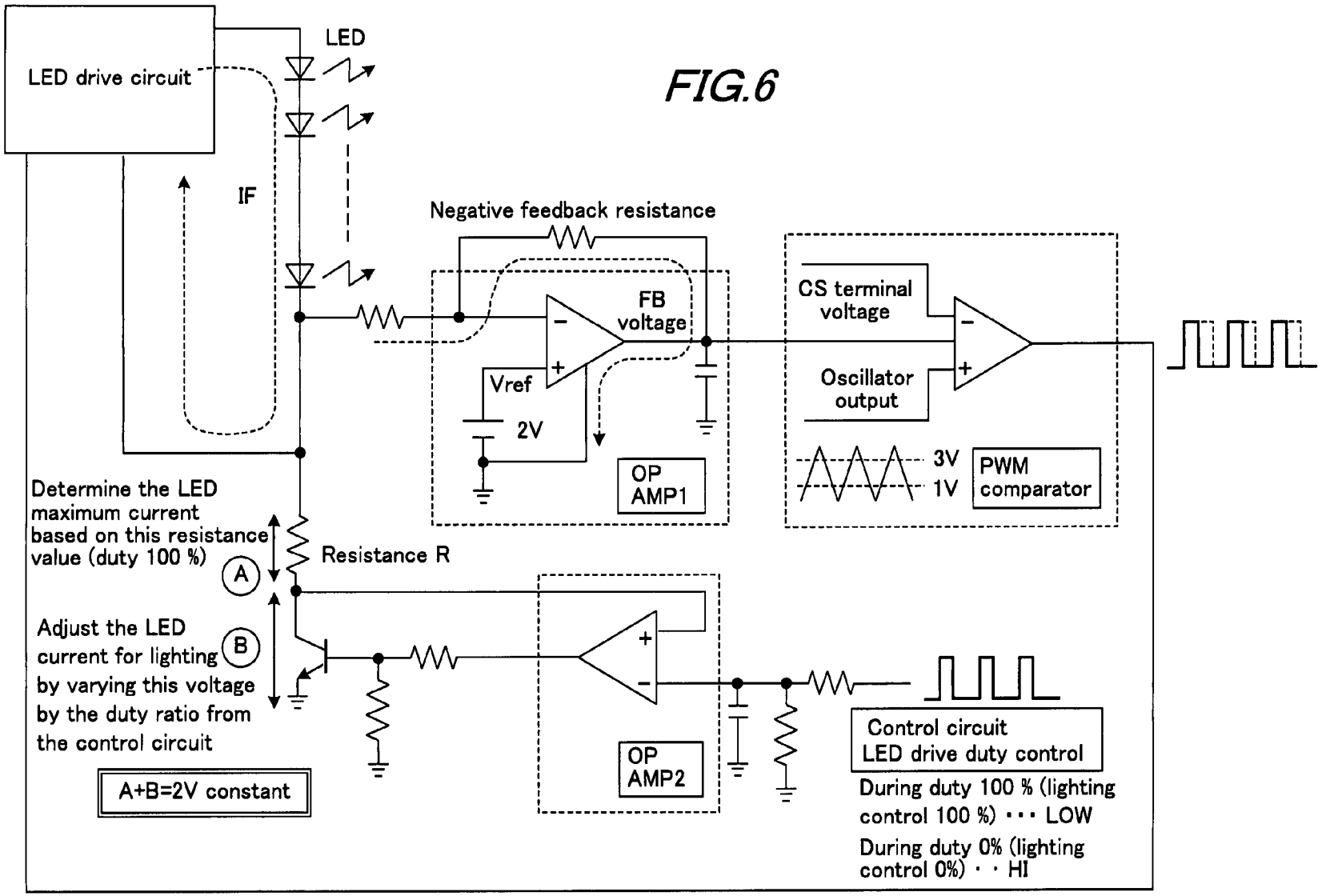
FIG. 6 is a diagram for illustrating lighting control on LEDs.

Referring to FIG. 6, the operation of lighting control of the red LEDs will be briefed specifically. In order to control the current IF flowing through (red) LEDs, the total voltage of "voltage A across the current detecting resistor R" plus "voltage B from the control circuit with the LED drive duty ratio" is monitored. Then, a comparison between the total voltage and "the noninverting input terminal voltage of OPAMP1 (op-amp) (Vref:2V)" is made, and the differential voltage between the total voltage and the noninverting input terminal voltage of OPAMP1 is input from OPAMP1 to a PWM comparator. The PWM comparator makes a comparison between a CS terminal voltage (3V) and the OPAMP1 output voltage (FB voltage), and slices a triangular wave output from an oscillator by the lower voltage to perform PWM control of LED drive on-duty ratio for switching. Thus, current IF for (red) LED drive can be stably controlled. Accordingly, OPAMP output terminal will present an FB voltage so as to always keep the inverting input terminal and the noninverting input of OPAMP1 at the same potential level.

Here, when red LEDs are turned on, in order to set the voltage at the inverting input terminal of OPAMP1 into 2 V, the potential (FB voltage) at the output terminal of OPAMP1 increases, and the LED drive on-duty ratio is increased to thereby enhance the red LED current IF. As LED current IF begins to flow, the potential at the V inverting terminal increases. When the voltage at the inverting input terminal of OPAMP1 exceeds 2 V, OPAMP1 starts a negative feedback control, specifically, drawing current through an OPAMP negative feedback resistor so as to lower the output voltage (FB voltage) of OPAMP1.

When the output voltage (FB voltage) from OPAMP1 drops so that the LED drive on-duty ratio is controlled to be lower, LED current $I_F$ lowers and the inverting input terminal of OPAMP1 is controlled to be as high as 2V, thus achieving a stable operation. As to current lighting control of LEDs, the voltage B is increased or decreased in accordance with the LED duty ratio from the control circuit, whereby current $I_F$ through the LEDs, calculated as "(2V-voltage B)/current detecting resistor R)", is controlled. When the LED duty ratio given from controller 50 is 100%, voltage B is minimized so that voltage A becomes maximum, hence LED current IF is maximized. On the other hand, when the LED duty ratio given from controller 50 is 0%, voltage B is maximized so that voltage A becomes minimum, hence LED current IF is minimized.

As described heretofore, setting the CFL duty ratio at 100% makes it possible to stably turn on LED module 34 without causing a sharp reduction of the brightness of LED module 34.

On the other hand, when the detected temperature value T is equal to or higher than the set temperature value T1 (Step S12; No), lighting control is made by setting the user set value for the CFL duty ratio (Step S14). Here, as the user set value "brightness" of video adjustment setup information 62 is read out from storage 60, and the duty ratio corresponding to that brightness is determined. Controller 50 then outputs INV output control signal S1 corresponding to the determined duty ratio to INV circuit 42. INV circuit 42, based on the input duty ratio, turns on CFL module 32. Then, in the same manner as Step S22, lighting of red LED module 34 is controlled (Step S16).

Subsequently, a comparison between the detected temperature value T and the set temperature value T2 that has been stored beforehand is made (Step S18).

At this point, if the detected temperature value T is equal to or greater than the set temperature value T2, the same operation is repeated from Step S14 (Step S18; No->Step S14). When the detected temperature value T has become smaller than the set temperature value T2, the operation goes to Step S20. (Step S18; Yes->Step S20). That is, in this case, the CFL duty ratio is set again into 100% to perform lighting.

Figure 7:
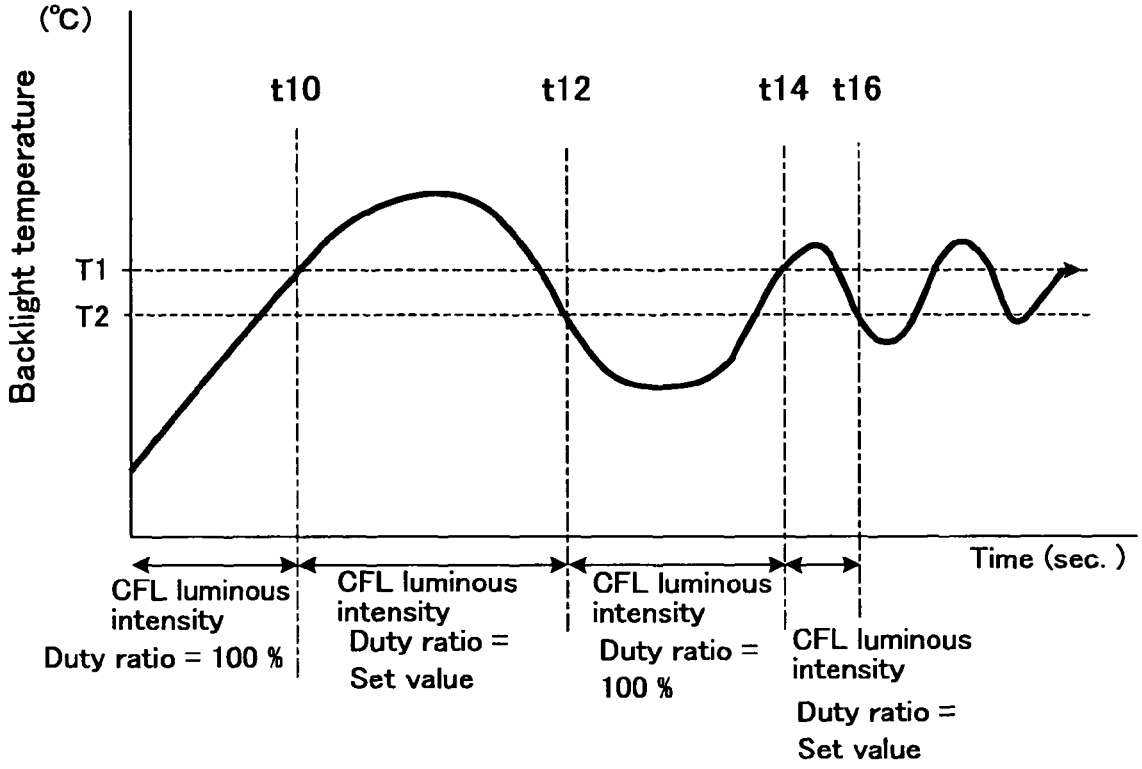
FIG. 7 is a chart showing the relationship of the temperature of a backlight depending on time.

FIG. 7 is a graph showing the temperature variation of LCD television 1 dependent on time in the present embodiment. In the graph in FIG. 7, the vertical axis represents the detected temperature value (temperature of the backlight: deg.) while the horizontal axis represents time (sec.).

First, since the backlight temperature is lower than set temperature value T1 from time "0" sec., the CFLs are operated to illuminate with a duty ratio of 100%. Subsequently, at time "t10" sec., the backlight temperature reaches T1. At this point, the CFL luminous intensity is changed so that the duty ratio is set at the value designated by the user. After passage of a certain period, the backlight temperature goes down to lower than set temperature value T2 at "t12". At this point, the CFLs are operated to illuminate with the duty ratio set at 100%. Then at time "t14" sec., the backlight temperature exceeds "T1, and the CFL luminous intensity is changed so that the duty ratio takes the value designated by the user.

In this way, as time goes by, the backlight temperature will converge in a temperature between T1 and T2. As a result, CFLs are turned on with illumination of LEDs, so that it is possible to reproduce highly color-balanced image display.

As an alternative, when the CFL luminous intensity is switched, for example, at time "t10" when the duty ratio for the CFL luminous intensity is changed from 100% to the designated value, it is possible to make control so as to change the duty ratio stepwise instead of changing it at once. Thus, stepwise switching of the luminous intensity makes it possible to adjust the CFL luminous intensity without the user knowing it.

[Operation and advantage]

Accordingly, use of the present invention makes it possible to perform reliable control of the LED luminous intensity in accordance with the brightness of the CFL light source even when the CFL brightness is low when the display is started up at low temperatures. As a result, it is possible to prevent luminous color imbalance of the backlight due to change in brightness of the light source. Resultantly, it is no longer necessary to design the control range of LED luminous intensity in conformity with the full variation of the CFL luminous intensity, and it is possible to solve the flickering problem and others which would occur when the current flowing through LEDs is low.

Further, in the hybrid backlight in which many LEDs are connected in series, the voltage variation can be minimized so as to be able to stabilize the current flowing through all the LEDs. Hence, it is possible to expect a significant advantage.

[Variational Example]

Though the above description of the embodiments was made referring to an LCD television as an applied example, the LCD device of the present invention should not be limited to those products. That is, the present invention can be applied to any product that uses liquid crystal for its display. For example, the present invention can be applied to various kinds of devices such as cellar phones, personal computers, PDAs (personal digital assistants), LCD monitors, car navigation systems and others.

Further, though in the present embodiment, the detected temperature value T is compared to two set temperature values T1 and T2, comparison may be made with set temperature value T1 only. Specifically, in the operation flow in FIG. 5, the iteration process from Step S14 maybe started after completion of Step S16. This is because in a usual usage environment, the backlight temperature would rise and it is implausible that the backlight temperature will go down during illumination.

What is claimed is:

1. A liquid crystal display device comprising:

a liquid crystal display element;

a backlight disposed on a rear side of the liquid crystal display element, the backlight comprising:

a first light source; and a second light source different in spectral characteristics from the first light source;

a first lighting control means for performing lighting control of the first light source by applying a voltage to the first light source with a predetermined duty ratio;

a second lighting control means for performing lighting control of the second light source by applying a voltage to the second light source with a predetermined duty ratio;

a temperature detecting means for detecting the temperature inside the liquid crystal display device; and a color sensor for detecting RGB values of light emitted from the backlight, wherein the first lighting control means performs lighting control by applying a voltage to the first light source with a duty ratio of 100% until the temperature detected by the temperature detecting means becomes equal to or greater than a first predetermined temperature, wherein the first light source is composed of cathode fluorescent lamps, and the second light source is composed of light emitting diodes, and wherein the second lighting control means determines the duty ratio for the second light source in proportion to the RGB values detected by the color sensor, and thereby performs lighting control in such a manner that luminous intensity of the light emitting diodes is in proportion to the brightness of the cathode fluorescent lamps.

2. The liquid crystal display device according to claim 1, further comprising:

a duty ratio setup means for setting the duty ratio for the first light source, wherein when the temperature detected by the temperature detecting means has become equal to or greater than the first predetermined temperature, the lighting control of the first light source is performed by applying a voltage to the first light source with the duty ratio set by the duty ratio setup means.

3. The liquid crystal display device according to claim 1, wherein when the temperature detected by the temperature detecting means became equal to or greater than the first predetermined temperature, and then has become lower than a second predetermined temperature that is lower than the first temperature, the first lighting control means performs lighting control by applying a voltage to the first light source with a duty ratio of 100%.

4. A liquid crystal display device comprising:

a liquid crystal display element;

a backlight disposed on a rear side of the liquid crystal display element, the backlight comprising:

a first light source; and a second light source different in spectral characteristics from the first light source;

a first lighting controller for performing lighting control of the first light source by applying a voltage to the first light source with a predetermined duty ratio;

a second lighting controller for performing lighting control of the second light source by applying a voltage to the second light source with a predetermined duty ratio;

a temperature detector for detecting the temperature inside the liquid crystal display device; and a color sensor for detecting RGB values of light emitted from the backlight, wherein the first lighting controller performs lighting control by applying a voltage to the first light source with a duty ratio of 100% until the temperature detected by the temperature detector becomes equal to or greater than a first predetermined temperature, wherein the first light source is composed of cathode fluorescent lamps, and the second light source is composed of light emitting diodes, and wherein the second lighting controller determines the duty ratio for the second light source in proportion to the RGB values detected by the color sensor, and thereby performs lighting control in such a manner that luminous intensity of the light emitting diodes is in proportion to the brightness of the cathode fluorescent lamps.

5. The liquid crystal display device according to claim 4, further comprising:

a duty ratio setup portion for setting the duty ratio for the first light source, wherein when the temperature detected by the temperature detector has become equal to or greater than the first predetermined temperature, the lighting control of the first light source is performed by applying a voltage to the first light source with the duty ratio set by the duty ratio setup portion.

6. The liquid crystal display device according to claim 4, wherein when the temperature detected by the temperature detector once becomes equal to or greater than the first predetermined temperature, and then becomes lower than a second predetermined temperature that is lower than the first temperature, the first lighting controller performs lighting control by applying a voltage to the first light source with a duty ratio of 100%.

* * * * *